United States Patent [19]

Tuson

[11] 4,227,830

[45] Oct. 14, 1980

[54] ANCILLARY OFF-SHORE COLUMN LOCATED NEAR A SEA-BED WORKING COLUMN OR PLATFORM

[75] Inventor: Samuel Tuson, Mesnil-le-Roi, France

[73] Assignee: Entreprise d'Equipements Mecaniques et Hydrauliques E.M.H., France

[21] Appl. No.: 918,686

[22] Filed: Jun. 23, 1978

[30] Foreign Application Priority Data

Jun. 30, 1977 [FR] France ..... 77 20164

[51] Int. Cl.[2] ..... E02D 21/00

[52] U.S. Cl. ..... 405/195; 405/202

[58] Field of Search ..... 405/195-209; 166/364; 175/219; 114/264, 265; 169/69; 431/202

[56] References Cited

U.S. PATENT DOCUMENTS

| | | | |
|---|---|---|---|
| 819,317 | 5/1906 | Shrewsbury | 405/195 |
| 3,145,539 | 8/1964 | Estes et al. | 405/205 X |
| 3,378,086 | 4/1968 | Kivisild | 114/264 X |
| 3,666,395 | 5/1972 | Kubasta | 431/202 |
| 3,714,788 | 2/1973 | Mott | 405/205 |
| 3,765,463 | 10/1973 | Gassett et al. | 114/264 X |

OTHER PUBLICATIONS

Fortune, Feb. 1965, p. 132.

Ocean Industry, Mar. 1973, p. 30.

*Primary Examiner*—Dennis L. Taylor

*Attorney, Agent, or Firm*—Steinberg and Blake

[57] ABSTRACT

The invention is concerned with an auxiliary off-shore column located near a working column or platform for sea-bed exploitation. Said auxiliary column is fitted up at least in part between its top and the main float with dwelling rooms, living quarters or like accommodation facilities for the staff on duty on the working column or platform. Said auxiliary column also comprises means for providing on at least temporary communication between both columns with a view to transferring said staff.

18 Claims, 9 Drawing Figures

ANCILLARY OFF-SHORE COLUMN LOCATED NEAR A SEA-BED WORKING COLUMN OR PLATFORM

The present invention relates essentially to an ancillary off-shore column or like auxiliary off-shore tower or platform structure.

More particularly, the present invention is directed to an ancillary off-shore column located near or close to a sea-bed working or development column, tower or like platform structure.

In the prior state of the art is already known a working column or an ancillary column of the so-called compliant or articulated or oscillating type which is pivotally connected at its submerged lower part to a base structure resting on the sea-floor or bottom whereas its upper portion emerging from the sea preferably comprises at its top an alighting or landing area or like deck or pad for instance for helicopters and similar rotary wing aircraft whereas the underwater or submerged lower portion lying below the surface or sea level is fitted with a main float or like buoyant body means providing for the stability of the column in an at least approximately vertical or upright position. The top portion of the column comprises the oil servicing, conditioning, handling or processing equipment or outfit proper in particular in the case of a sea-bed working column or a small part thereof in the case of an ancillary column such as for instance a flare-stack carrying column.

The so-called "ancillary" articulated column may of course be coupled to a fixed working platform which is rigidly secured onto the seabed.

Thus in the specification and claims the term "column" refers to any articulated column, platform or tower structures raising from the sea bottom upwards to above sea level, i.e. including any alternative embodiments thereof. The term "platform" refers to any stationary or immovable platform fixedly secured to the sea-bed. At last the expression "working column" or "working platform" refers to any column or platform enabling any operation required for the extraction, the handling, the storage etc . . . of oil-field products to be performed. Among such operating steps are for instance the well-drilling or boring, the production, the separation, the loading or unloading of tanker ships a.s.o.

The working column or platform always comprises on its emergent portion forming the top or head structure the aforesaid petroleum servicing equipment or outfit or like processing facilities or treating plants as well as living quarters or like dwellings or accommodations for the operating crew, staff or team of the working column or platform. Such an operating staff or personnel is relatively high in number varying according to the size of the working column or platform. It may thus for instance comprise about 300 people.

It will be readily understood that the numerous operating staff present on the working column or platform incurs some risks in case of serious troubles occurring on the working column or platform such as for instance a fire hazard. People cannot indeed get easily out of range of or escape from the working column or platform, i.e. get away to a safe distance or reach from said column because they have always to take an air transport means such as a helicopter and/or a sea transport means which is not always available nearby for being evacuated from the working column or platform. Rescue is thus likely to be delayed thereby endangering the personnel and this is not tolerable.

A main object of the present invention is therefore to overcome the aforesaid drawbacks by providing means for harbouring, sheltering or accommodating the personnel at a safe distance from the working column or platform while providing that part of the personnel which is on duty on the working column or platform with an easy and quick communication path enabling them to proceed to or to leave said working column or platform.

The approach according to the invention consists in an ancillary off-shore column of the kind previously defined and characterized in that said ancillary column is designed to be fitted up with or to house at least in part between its top and the main float, living quarters or like harbouring rooms or dwelling accommodations for the service staff operating said working column or platform and in that there are provided at least temporary communication means between both columns for transferring said staff. Preferably the communication means comprise a footbridge or like gangway connecting said fitted-up part to said working column or platform.

Thus the operating staff or personnel is safely harboured or accommodated close to the working site constituted by the working column or platform. The staff may also live autonomously or independently for an extended period of time on the ancillary column with all the safety required. Moreover, owing to the footbridge or gangway, that part of the operating staff which is on duty on the working column or platform may go on board or leave the latter very quickly. In case of trouble occurring on the working column or platform such as the outbreak of a fire only that part of the staff which actually is on duty is present on the working column or platform whereas the other part of the staff which may form the major part thereof is staying on the ancillary column forming a kind of "hotel".

Preferably and according to a first embodiment of the invention the footbridge consists of at least two elements pivotally connected to each other in series, said footbridge being supported at an intermediate point by a floating or buoyant assembly, the overall length of both elements being greater than the greatest distance separating the harbouring or dwelling column from the working column or platform at the level of the footbridge. Thus this preferred embodiment provides a non-rigid communication between the dwelling column and the working column or platform. The dwelling column may therefore perform an oscillating or swinging motion under the action for instance of the swell or surge or of the wind. It results therefrom that the footbridge would sustain weak forces or stresses and may accordingly be built to be of a relatively light weight construction.

According to another embodiment of the invention, the communication footbridge or like link span is substantially shorter than the least normal distance between the dwelling column and the working column or platform at the level of the footbridge, this working column or platform comprising a means for artificially and forcibly causing the dwelling column to tilt or lean towards the working column or platform. According to a further characterizing feature of the invention, the footbridge is carried or supported by one of the two columns and is bearing upon the other column in the inclined position of the dwelling column. Owing to this embodiment, the footbridge may be shorter and of a lighter weight. On the other hand, by causing the dwelling column to be urgently raised back to its vertical position for instance in an emergency case, the fitted-up dwelling part thereof will be remote enough to protect the staff which while being out of harm's way may then possibly wait for help or for being evacuated.

The invention will be better understood and further objects, characterizing features, details and advantages thereof will appear more clearly as the following explanatory description proceeds with reference to the accompanying diagrammatic drawings given by way of non-limiting examples only illustrating several presently preferred specific embodiments of an ancillary column forming a dwelling column according to the invention and wherein.

Figure 1:
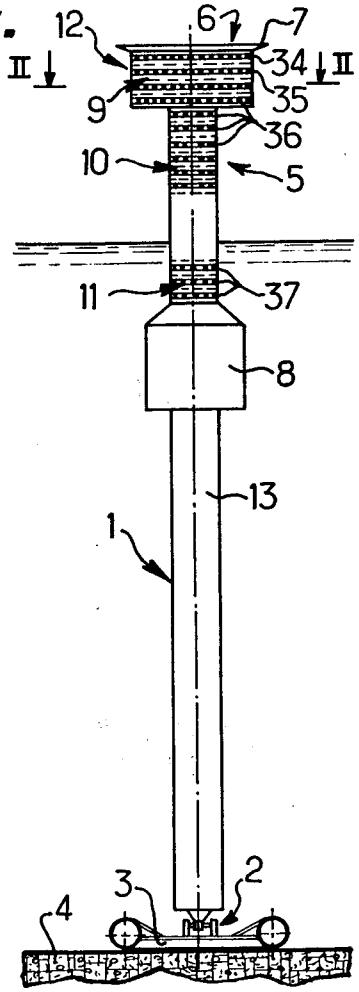
FIG. 1 is a diagrammatic view in partial longitudinal section of a first embodiment of a dwelling column according to the invention.

Referring to FIG. 1, an ancillary off-shore column according to the invention is located near a working column or platform for sea-bed exploitation (see FIGS. 3 and 5 to 9). This auxiliary column is pivotally connected with its submerged lower portion 1 by means of a pivotal connection 2, preferably of the type forming a universal or Hooke's or Cardan joint coupling, to a base member 3 resting on the sea floor or bottom 4. The emerging upper portion of this column comprises preferably at its top 6, an alighting or landing area, pad or deck 7 for instance for helicopters or like rotary wing aircraft. The submerged lower portion 1 comprises a main float 8 for causing the auxiliary column to be kept in or urged towards an at least approximately vertical or upright position.

The auxiliary column is fitted up at least in part between its top 6 and the main float 8 with living quarters or like dwelling or harbouring rooms 9, 10, 11 for the operating staff or personnel on duty on the working column or platform.

Figure 2:
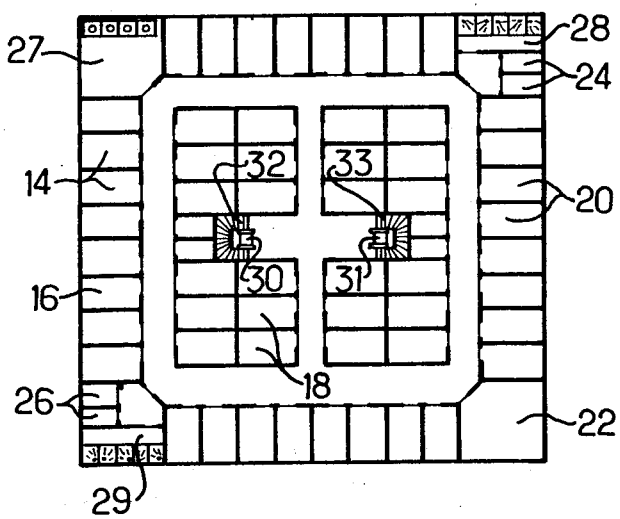
FIG. 2 is a view in cross-section taken upon the line II—II of FIG. 1.

Preferably in the fitted-up portion (9, 10, 11), the auxiliary column forming a dwelling column comprises a column segment or trunk 12 having a cross-sectional surface area substantially greater than the crosssectional surface area of the column shaft 13. Preferably this column trunk 12 forms the head of the column. The architectural design of the column is dependent on various parameters such as the number of individuals to accommodate thereon, the installation site or location and in particular the depth of water. In the illustrated example, the depth of water is 150 m, the height of the column is in a range of from about 200 m to 250 m, the diameter of the column shaft 13 is 10 m whereas the column trunk 12 has a cross-sectional contour of 25 m square as is clearly seen on FIG. 2. Each story of the column is fitted up to offer the greatest comfort to the staff. Thus as seen in FIG. 2, each story comprises many rooms such as 14, 16, 18, 20 (for two individuals), 22 (for four individuals), dressing-rooms or lavatories or water-closets such as 24, 26, a scullery or laundry or like washing-place 27, shower-baths 28, 29, elevators or lifts 30, 31, staircases 32, 33 etc . . . This column trunk of relatively greater size than the general size of the column shaft enables that volume of the dwelling column which is capable of being fitted up with accommodation facilities to be substantially increased while preventing the emergent upper part 5 from being made too high. The stories of the column may for instance be arranged as follows: a story 34 forming a machinery room, a story 35 for accommodating the kitchens and the dining or mess room, several stories 36 fitted up with bedrooms, sitting-rooms, living-rooms and for instance a plurality of storeys 37 forming relaxation-rooms located below sea level but above the main float 8.

Furthermore at least temporary communication means are provided between the dwelling column and the working column or platform for staff transfer. These communication means consist for instance of air transport means such as helicopters adapted to land or rest on the landing area or deck 7 and to fly between the dwelling column and the working column or platform.

These communication means preferably comprise a footbridge or like gangway connecting the fitted up portion (9 or 10) to the working column or platform. The distance separating the dwelling column from the working column varies between large limits and preferably is in a range from about 120 m to about 300 m.

Thus the staff is accommodated at a relatively great distance, i.e. rather far or remote from the working column or platform. Such a distance is great enough to have the staff accommodated on the dwelling column in full safety however serious a possible trouble occurring on the working platform or column may be. On the other hand, owing to said communication means, that part of the operating staff which is on duty on the working platform may go to and come back from the latter within a very short period of time and therefore become quickly secure against danger.

Figure 3:
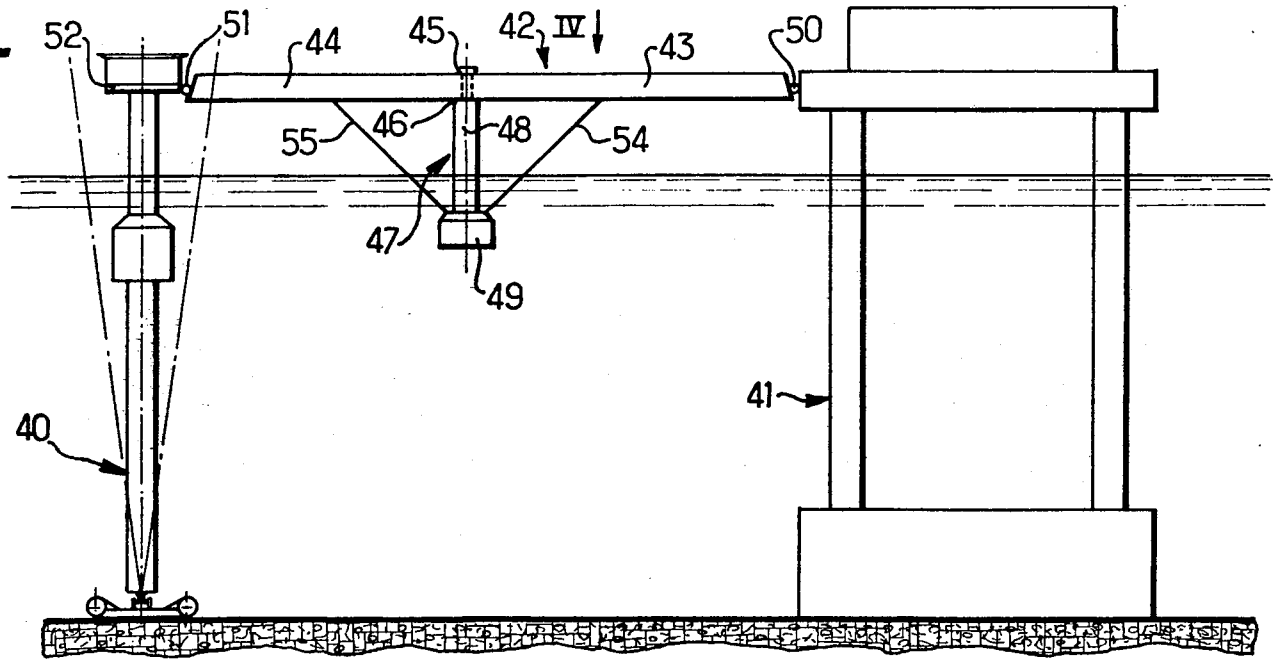
FIG. 3 is a diagrammatic view showing a second embodiment in which the dwelling column comprises a footbridge for communication with a working platform.

With reference to FIG. 3, the dwelling column 40 is connected to a working platform 41 through a footbridge 42 consisting of two elements 43, 44 arranged in series and pivotally connected to each other by means of a pivotal connection 45. The footbridge 42 is supported at an intermediate point 46 thereof by a float or buoyant assembly 47. The overall length of both component members 43, 44 of the footbridge is higher than the greatest distance separating the dwelling column 40 from the working column 41 on this level. For instance, if the distance between the dwelling column 40 and the working platform 41 is 200 m, the length of each one of both elements would be 120 m.

Preferably the float or buoyant device 47 is located at the pivotal connection 45 between both elements 43, 44 of the footbridge 42 and the device 47 carries the footbridge 42 by means of a mast or post 48 extending in substantially coaxial relationship with the pivot axis and topping the float body 49 proper. Also preferably, the element 43 is connected through a pivotal connection 50, in particular of the ball-and-socket joint type, to the working platform 41 whereas the element 44 is also connected through the pivotal connection 51 in particular of the ball-and-socket joint type too, with the dwelling column 40. The footbridge 42 is advantageously pivotally connected to the dwelling column on a swivelling crown or rotary head or like turntable 52 mounted in coaxial relationship on the dwelling column 40.

Figure 4:
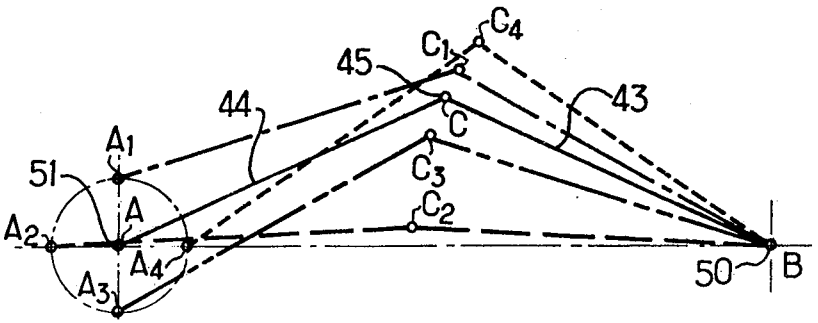
FIG. 4 is a diagram illustrating the various configurations of the footbridge according to the oscillations of the dwelling column, as viewed from above in the direction of the arrow IV of FIg. 3.

Thus, owing to that construction of the communication means, the footbridge 42 always forms a broken line as clearly seen in FIG. 4.

If indeed the respective end positions of the pivotal connection 51 between the element 44 of the footbridge 42 and the dwelling column 40, due to the oscillation of the column 40, are designated by the reference characters A, $A_1$, $A_2$, $A_3$, $A_4$, the pivotal connection 50 between the element 43 of the footbridge 42 and the platform 41 is designated by the reference character B, and the respective positions of the pivotal connection 45 between both elements 43, 44 of the footbridge 42 are designated by the reference characters C, $C_1$, $C_2$, $C_3$, $C_4$, it appears that the greatest distance $A_2$-B separating the dwelling column 40 from the working platform 41 is shorter than the overall length $A_2$-$C_2$-B of both component members 44, 43 of the footbridge 42 (see FIG. 4).

It results therefrom that owing to its deformability, the footbridge 42 will undergo weak forces or stresses only under the effect of the swinging motion of the dwelling column 40. The footbridge 42 may therefore be of a light-weight construction, more especially as the bending stresses exerted upon the elements 43, 44 in view of their weights are rather low owing to the provision of the float or buoyant device 47 at an intermediate point 46 of the footbridge 42. This approach therefore offers the greatest deal of advantages because it enables the dwelling column 40 to be located away from the working platform 41 by a distance quite sufficient to enable the staff living in the dwelling column to be accommodated there with all required safety and in an autonomous or independent manner for an extended period of time. This approach also offers the advantage to enable the staff on duty to communicate with the working platform 41 very easily and quickly.

The float device 47 and the elements 43, 44 of the footbridge 42 are advantageously connected by stiffening stay members or bars 54, 55 providing for keeping the float device better in position. These reinforcing stay members may possibly be connected to the working platform. The footbridge is designed to be detachable or removable from the dwelling column 40 and/or from the working platform 41. This footbridge 42 may comprise more than two elements.

Generally the footbridge may also consist of one single or unitary element without any intermediate support and at least one of its ends is then connected through a pivotal connection in particular of the ball-and-socket joint type to the dwelling column or to the working column or platform.

Figure 5:
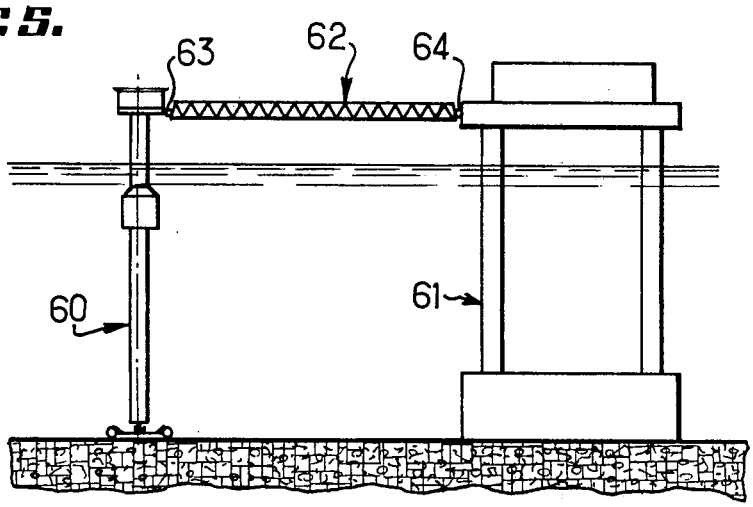
FIGS. 5 and 6 show further embodiments of the footbridge.

Thus referring to FIG. 5, a dwelling column 60 is connected to a working platform 61 through the agency of a rigid footbridge 62 which is pivotally connected with one end thereof by means of a pivotal connection 63 to the dwelling column 60 and with its other end through a pivotal connection 64 to the working platform 61. The pivotal connections 63, 64 are of any known type and preferably of the ball-and-socket joint or swivel joint or toggle joint type. The length of the footbridge may be of about 120 m. In this embodiment, since the footbridge 62 is not deformable, the dwelling column 60 may not oscillate fully freely under the effect in particular of the surge or swell and of the wind so that it will exert substantial, in particular compression stresses upon the footbridge. In view of this and owing to the absence of any intermediate support, the footbridge is designed to be shorter than in the previous embodiment shown in FIG. 3.

Figure 6:
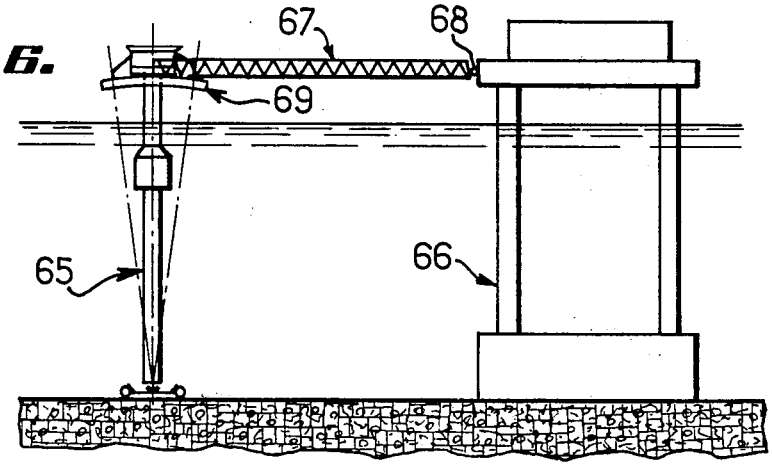

In the embodiment shown in FIG. 6, the dwelling column 65 is connected to the working platform 66 through a rigid footbridge 67. One end of the footbridge 67 is connected by means of a pivotal connection 68 preferably of the ball-and-socket joint type to the working platform 66 whereas the other end of the footbridge 67 is supported in relatively free sliding or in guided relationship on a bearing provided on the dwelling column 65. The pivotal connection may of course be provided between the footbridge 67 and the dwelling column 65 and the sliding bearing relationship may be provided between the footbridge 67 and the working platform 66. This approach enables the dwelling column to oscillate freely under the action for instance of the swell or surge or of the wind since the dwelling column 65 is not located at a constant distance of connection through the footbridge 67 from the working platform 66 as in the examplary embodiment shown in FIG. 5. The footbridge 67 could accordingly be longer because there is no danger of buckling.

Figure 7:
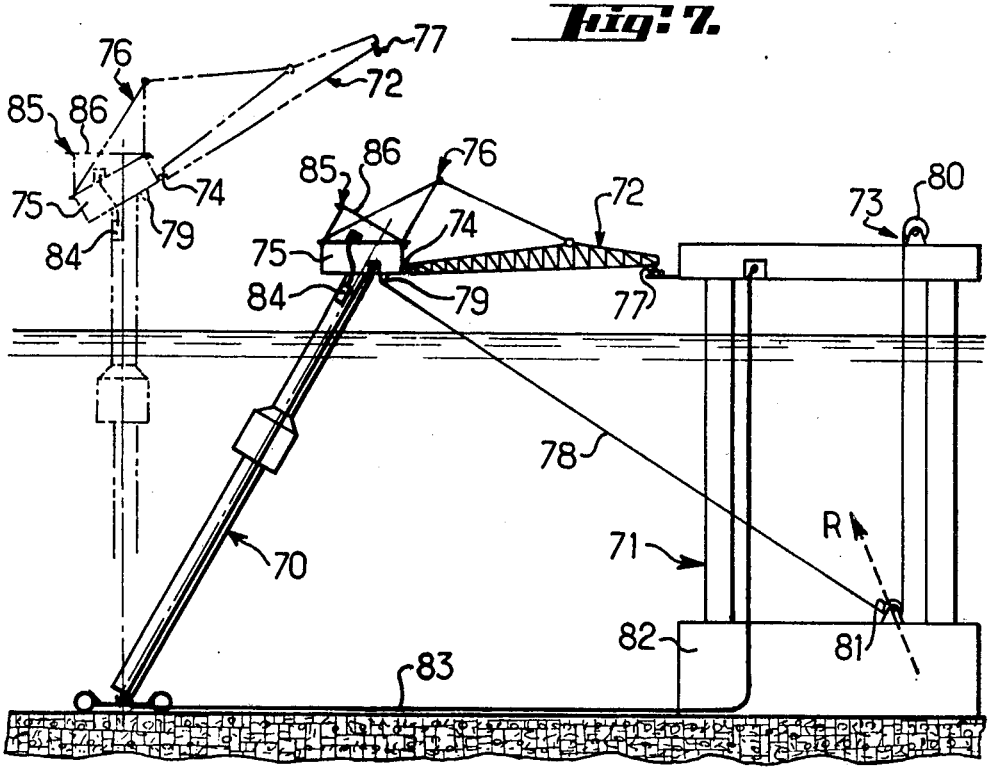
FIG. 7 illustrates another embodiment of the dwelling columnfootbridge combination wherein the dwelling column is inclined in its normal operating position.

Referring to FIG. 7, the dwelling column 70 is connected to the working platform 71 through a communication footbridge 72 which is substantially shorter than the least normal distance, at its level, between the dwelling column 70 and the working platform 71. This working platform 71 comprises a means 73 for artificially causing the dwelling column 70 to forcibly tilt towards the working platform 71. The footbridge 72 is preferably carried by the dwelling column 70 and would bear through any known system on the working platform 71 in the inclined position of the dwelling column as shown in solid lines. It should be understood that the footbridge may possibly be pivotally connected to the working platform.

The footbridge 72 is connected through a pivotal connection 74 preferably of the ball-and-socket joint type with one end thereof to the head 75 of the dwelling column. The footbridge 72 is held, possibly in a manner enabling it to be lifted or raised like a drawbridge, by a guying system 76 or by any other equivalent device mounted on the head 75. The other end of the footbridge 72 is adapted in the lower position of the footbridge 72 to be caused to movably bear through the agency of a bearing system 77 for instance in rolling or sliding contact upon the working platform 71.

This guying system for the footbridge may advantageously be used with the embodiments shown in FIGS. 5 and 6. Thus the footbridge may be raised or swung upwards if need be.

The forced-tilting means 73 consists of a pull rope or cable 78 fastened to the dwelling column 70 preferably through a quick releasing or disconnecting device 79 and is wound up on an operating winch 80 placed on the working platform 71. Preferably a return-pulley 81 for guiding the cable 78 is positioned on the working platform 71 at such a depth that the direction of the pull reaction R upon the working platform 71 is meeting with or intersects the base polygon of support or of equilibrium of the latter at about one third of its transverse dimension lying in the vertical plane of that reaction R. Preferably this pulley 81 is arranged on the base member 82 of the working platform. In all the examplary embodiments described the dwelling column 70 may be supplied with power through a submarine or underwater feed line 83 connecting with or leading from the working platform 71. The dwelling column 70 may also comprise an emergency or stand-by power generator set 84.

Since the dwelling column 70 is kept in an inclined position in its normal configuration of use, the floors of the dwelling rooms of the dwelling column 70 are inclined with respect to the longitudinal centre line axis of the dwelling column 70 by an angle equal to the forced-tilting angle in normal service of said column 70 in relation to the horizontal direction so that such floors be substantially horizontal in that position.

The dwelling column 70 may also comprise emergency living quarters or accommodations 85 the floors of which are substantially at right angles to the longitudinal centre line axis of the dwelling column 70. It should therefore be understood that in the raised upstanding position of the dwelling column 70 shown in chain-dotted lines the floors of the emergency living quarters 85 are in a substantially horizontal position. A landing area, pad or deck 86 for helicopters is also provided over the living quarters 85 so as to enable such helicopters to land in the upwards swung upright position of the column.

In all the embodiments of inclined column, the emergency living quarters 85 may advantageously be omitted or dispensed with. It is then enough that the head 75 lived in be pivotally connected to the top of the column 70 in a swivelling manner and provided with a for instance hydraulically operated servo-drive system or like powered actuator for selectively controlling the inclination. Thus the floors of the dwelling rooms may always be moved to a substantially horizontal position irrespective of the instant inclination of the column. The pivotal connection 74 of the footbridge 72 is of course independent of that of the head 75 of the column 70.

The inclination of the column may be variable and the angle of greatest inclination is for instance of about 30°. The distance separating the head of the column 75 in the upwards swung upstanding position of the column 70, from the working column 71 is of about 200 m in the examplary embodiment shown. For putting it into service the column 70 is caused to be tilted by 30° for normal use by means of the winch 80 acting upon the cable 78. The head 75 of the column 70 is then located at a distance of about 80 m only from the working platform 71. The footbridge 72 is then lowered or swung downwards onto the working platform 71 by means of the guying system 76 thereby enabling the operating staff to come very quickly on the working platform 71 since the length of the footbridge is relatively short. The footbridge may be designed to be rigidly secured onto the dwelling column 70 so that through tilting of the column 70 the footbridge 72 automatically reaches the working platform 71. The pivotal connection of the footbridge 72 however enables it to be lifted or swung upwards as soon as the weather conditions are likely to induce exceedingly large relative transverse movements.

The column 70 is kept in the forcibly inclined position in a relatively rigid manner in normal service. Thus the tension of the cable should be higher than the outer dynamic effects due for instance to the surge or swell and to the wind.

If a trouble occurs on the working platform 71 the staff on duty on the working platform 71 may go back to the dwelling column 70 very quickly because the footbridge is short. All the staff is transferred to the emergency living quarters 85 whereas the quick disconnecting device 79 is released thereby causing the column to be swung upwards through the action of the restoring torque due to the main float of the dwelling column 70. The emergency living quarters or accommodations 85 are then located at a distance of about 200 m from the working platform 71 and the staff is there secure from danger and may wait for being evacuated by means of helicopters which will land on the landing area or deck 86. On the other hand as the footbridge is relatively short it may be of light-weight construction.

Figure 8:
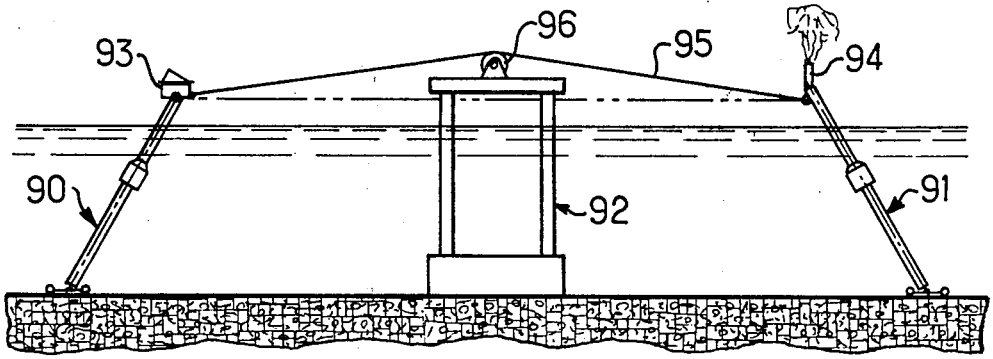
FIGS. 8 and 9 show still further embodiments wherein the dwelling column is coupled on the one hand to a working platform and on the other hand to a flare-stack carrying column.

According to an alternative embodiment of the forced inclination of the column as shown in FIG. 8, a dwelling column 90 is coupled to an auxiliary column 91 so that both columns 90, 91 are arranged in substantially symmetrical relationship on either side of a working platform 92. The heads 93, 94 of the dwelling column 90 and of the ancillary column 91 are respectively connected to each other through a cable 95 which may be quickly disconnected from the dwelling column 90 and the length of which is substantially smaller than the distance separating both columns 90, 91 from each other in their respective vertical positions. The connecting cable 95 is preferably reeved over an elevated guide sheave 96 mounted on the working platform 92 and at least one of both columns 90, 91 is connected to the working platform 92 through a footbridge for instance suspended and hanging from the cable 95 and fastened with one end thereof to the working platform 92. In the examplary embodiment illustrated the auxiliary column 91 is a flare-stack carrying column. The cable 95 may be arranged in horizontal position as shown in chain-dotted lines. Several cables may be used. The positioning of the cable is effected by ballasting the main floats of the dwelling column 90 and of the ancillary column 91, respectively. The dwelling column exhibits the same architectural design as that shown in FIG. 7 since it is inclined into a position of normal use. When a trouble occurs on the working platform 92, the staff is quickly transferred by means of the footbridge suspended from the cable 95 to the emergency rooms provided in the head 93 of the column 90. Upon disconnecting the cable 95, the columns 90, 91 will swing back to the vertical position wherein the head 93 of the column 90 is positioned at a security distance from the working platform 92. This embodiment therefore offers the same advantages as that shown in FIG. 7.

According to a modification, the pulley or sheave 96 may be replaced by two powered winch drums arranged preferably in coaxial relationship and which may mutually be selectively connected to and disconnected from each other. Each column head is connected to the platform by means of at least one cable adapted to be wound up on an associated winch drum different from that of the other cable. Both drums may be disconnected with a view to inclining each column separately and then they may be connected together rigidly so as to achieve an automatic balancing likely to substantially prevent the footbridge from being stressed or strained.

Figure 9:
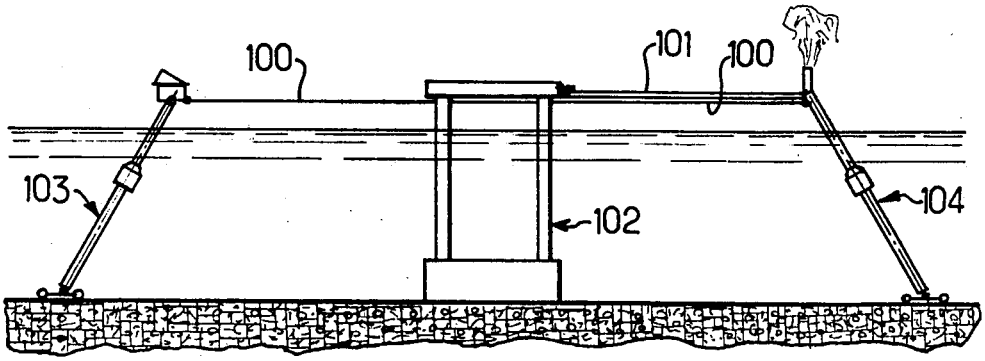

Another embodiment of forced inclination of the column is illustrated on FIG. 9. In that example the connecting cable or cables 100 are independent of the working platform 102 or are guided thereon and form either telpher cables or cables for supporting a lightweight footbridge providing communication between the dwelling column 103 and the working column 102. On the other hand the cables 100 provide support for a pipeline 101 feeding the ancillary column designed as a flare-stack carrying column 104 with gas from the working platform 102.

In the embodiments shown in FIGS. 8 and 9 wherein the dwelling column is coupled with an ancillary for instance flare-stack carrying column, the distance of the head lived in of the dwelling column in the inclined position of said dwelling column from the working column may be relatively large. Moreover, with the dwelling and auxiliary columns being symmetrically inclined with respect to the working platform, the tensions in the cables will balance. The distance separating the dwelling column from the working platform in the inclined position of the dwelling column may be of about 200 m whereas that distance becomes about 300 m when the dwelling column is swung back to its vertical position. The safeness distance is accordingly increased to a substantial extent. When using a telpher system the communication between the dwelling column and the working platform is very quick too.

Various modifications may be made to the embodiments shown. In particular when the dwelling column is used normally in a substantially vertical position, it may also be connected through a telpher system to the working platform (with a self-acting feedback control or adjustment of the tension of the carrier cable). Instead of a working platform, a working column may also be used.

The invention is not at all limited to the embodiments described and shown which have been given by way of illustrative examples only. In particular it comprises all the means constituting technical equivalents of the means described as well as their combinations if same are carried out according to its gist and used within the scope of the appended claims.

What is claimed is:

1. An auxiliary off-shore column located near a working column or platform for sea-bed exploitation, said auxiliary column being pivotally connected with its submerged lower part to a base member resting on the sea bottom whereas its emerged upper part comprises preferably at its top a landing area for instance for helicopters, said submerged lower part comprising a main float for keeping said auxiliary column in an at least approximately vertical position, wherein the improvement consists in that said auxiliary column is fitted up at least in part between its top and the main float with dwelling rooms, living quarters or like accommodation facilities for the staff on duty on said working column or platform and in that there are means for providing an at least temporary communication between both columns with a view to transferring said staff, said communication means comprising a footbridge connecting said fitted-up part to said working column or platform, said footbridge comprising at least two elements pivotally connected in series to each other, said footbridge being supported at an intermediate point thereof by means of a float device, the overall length of both elements being higher than the greatest distance separating, at its level, the dwelling column from the working column or platform.

2. The column of claim 1, wherein said float device is located at the pivotal connection between both elements of said footbridge and carries the latter by means of a mast extending in substantially coaxial relationship with the pivot axis and topping said float proper.

3. An auxiliary off-shore column located near a working column or platform for sea-bed exploitation, said auxiliary column being pivotally connected with its submerged lower part to a base member resting on the sea bottom whereas its emerged upper part comprises preferably at its top a landing area for instance for helicopters, said submerged lower part comprising a main float for keeping said auxiliary column in an at least approximately vertical position, wherein the improvement consists in that said auxiliary column is fitted up at least in part between its top and the main float with dwelling rooms, living quarters or like accommodation facilities for the staff on duty on said working column or platform and in that there are means for providing an at least temporary communication between both columns with a view to transferring said staff, said communication means comprising a footbridge connecting said fitted-up part to said working station or platform, and wherein said footbridge is shorter than the least normal distance, at its level, between the dwelling column and the working column or platform, said working column or platform comprising a means for artificially and forcibly tilting the dwelling column towards said working column or platform and in that the footbridge is carried by one of both columns and is bearing upon the other column in the inclined position of the dwelling column.

4. The column of claim 3, wherein the footbridge is pivotally connected with one end thereof to the head of the dwelling column while being held in a possibly liftable manner by a guying system mounted on said head, the other end being adapted in the lowered position of the footbridge to be caused to movably bear upon the working column or platform.

5. The column of claim 3, wherein said forced inclination means consists of a pull cable fastened to the dwelling column preferably through a quick-release device and winding up onto an operating winch placed on the working column or platform.

6. The column of claim 5, wherein a guide pulley for said cable is provided on the working column or platform at such a depth that the direction of the pull reaction exerted upon the working column or platform will meet with or intersect the base polygon of support or equilibrium thereof at about one third of its tranverse dimension lying in the vertical plane of such a reaction.

7. The column of claim 3, wherein the floors of the dwelling rooms or living quarters of the dwelling column are inclined with respect to the longitudinal centre line axis of the dwelling column by an angle equal to the angle of forced inclination in the normal tilted service position of said column with respect to the horizontal direction and in that the dwelling column also comprises emergency living quarters the floors of which are substantially at right angles to the longitudinal centre line axis of the column, a landing deck for helicopters being also provided over said living quarters.

8. The column of claim 3, wherein said fitted-up part of the dwelling column is pivotally connected in a swivelling manner to the top of said dwelling column and provided with a for instance hydraulically operated servo-controlled system or like power actuator for selectively controlling said inclination.

9. The column of claim 7, wherein said dwelling column and an auxiliary column are located in substantially symmetrical relationship with respect to and on either side of a working platform, the heads of said columns being interconnected by one or several cables which are quickly disconnectable from the dwelling column and the lengths of which are smaller than the distance separating both columns from each other in their respective vertical positions at that level.

10. The column of claim 9, wherein said connecting cable is reeved over an elevated guide sheave mounted onto the working column or platform and at least one of both columns is connected to the working column through a footbridge suspended from said cable and fastened with one end to said working column or platform.

11. The column of claim 7, wherein said dwelling column and an auxiliary column are positioned in substantially symmetrical relationship with respect to and on either side of a working platform, the head of each column being connected to the platform by at least one cable adapted to be wound up onto an associated powered winch drum mounted on said platform, both drums being preferably arranged in coaxial relation ship and selectively connectable to and disconnectable from each other.

12. The column of claim 9, wherein the connecting cable or cables are independent of said working platform or guided on the latter and from either telpher cables or cables for supporting a light-weight footbridge providing communication between said dwelling column and said working column.

13. An auxiliary off-shore column located near a working column or platform for sea-bed exploitation, said auxiliary column comprising a shaft with a top end emerging from the sea and a bottom end located near the sea bottom defining thereby an emerged upper part and a submerged lower part, the bottom end being pivotally connected to a base member resting on the sea bottom whereas the top end comprises preferably a landing area for instance for helicopters, the submerged lower part comprises a main float for keeping the shaft in an at least approximately vertical position, wherein the improvement consists in that said auxiliary column is fitted-up at least in part between its top end and the main float with dwelling rooms, living quarters or like accommodation facilities for the staff on duty on said working column or platform and in that there are means for providing an at least temporary communication between both columns with a view to transferring said staff.

14. The column of claim 13, wherein said fitted-up part, it comprises a column trunk with a cross-sectional surface area larger than the cross-sectional surface area of the column shaft.

15. The column of claim 13, wherein said communication means comprise a footbridge connecting said fitted-up part to said working column or platform.

16. The column of claim 15, wherein said footbridge consists of at least one element at least one end of which is connected through a pivotal connection in particular of the ball-and-socket joint type to either the dwelling column or the working column or platform.

17. The column of claim 15, wherein one of both ends of said footbridge is connected through a pivotal connection in particular of the ball-and-socket joint type to one of said two columns whereas the other end of the footbridge is relatively freely resting in sliding relationship on the other column.

18. The column of claim 15, wherein the footbridge is pivotally connected to the dwelling column on a swivelling crown or rotary head mounted in coaxial relationship onto the dwelling column.

* * * * *